US006415466B1

(12) United States Patent
Laiso

(10) Patent No.: US 6,415,466 B1
(45) Date of Patent: Jul. 9, 2002

(54) POCKET PILLOW AND SHEET FOR ADULT/CRIB ELEVATION SLEEP AID

(76) Inventor: Elene Laiso, 122 Hudson View Terrace, Highland Falls, NY (US) 10928

( * ) Notice: Subject to any disclaimer, the term of this patent is extended or adjusted under 35 U.S.C. 154(b) by 0 days.

(21) Appl. No.: 09/804,632

(22) Filed: Mar. 12, 2001

(51) Int. Cl.[7] ..... A47G 9/00

(52) U.S. Cl. ..... 5/485; 5/482; 5/655; 5/632; 5/624; 5/636; 5/640; 5/922

(58) Field of Search ..... 5/485, 655, 632, 5/630, 624, 636, 922, 640, 482, 646

(56) References Cited

U.S. PATENT DOCUMENTS 4,873,734 A * 10/1989 Pollard ..... 5/485
5,056,533 A * 10/1991 Solano ..... 5/655
5,189,748 A * 3/1993 Garrison et al. ..... 5/632
5,331,699 A * 7/1994 Patton et al. ..... 5/655
5,351,348 A * 10/1994 Beger ..... 5/655
5,357,641 A * 10/1994 Schubert ..... 5/424
5,991,946 A * 11/1999 Harris ..... 5/485
6,286,163 B1 * 9/2001 Trimble ..... 5/497
6,922,964 * 9/2001 Rose et al. ..... 5/632

* cited by examiner

*Primary Examiner*—Alexander Grosz
(74) *Attorney, Agent, or Firm*—Richard A. Joel, Esq

(57) ABSTRACT

A pocket pillow shape comprises a shape having a plurality of pockets on a reverse side thereof for the insertion of particular pillows. The pillows comprise a head pillow and side pillows spaced from one another and base pillows spaced from the head pillow defining a sleeping space therebetween. The side pillows comprise one or more contoured pillows while the base pillows comprise crescent shaped pillows which may be added or subtracted depending upon the elevation desired or the size of an individual located within the sleeping area. The contoured pillows may comprise a plurality of shaped strips having Velcro® or hook and loop fasteners to attach to one another to achieve a predetermined shape.

4 Claims, 3 Drawing Sheets

POCKET PILLOW AND SHEET FOR ADULT/CRIB ELEVATION SLEEP AID

CROSS-REFERENCE TO RELATED APPLICATIONS

None

STATEMENT REGARDING FEDERALLY SPONSORED RESEARCH OR DEVELOPMENT

Research and development of the present invention and application have not been federally sponsored, and no rights are given under any Federal program.

REFERENCE TO A MICROFICHE APPENDIX

Not applicable.

BACKGROUND OF THE INVENTION

1. Field of the Invention

This invention relates to a pocket pillow sheet wherein the sheet includes pockets on the reverse side thereof for the insertion of predetermined pillows so that a shaped configuration results on the topside of the sheet. The invention is designed for home use for infants and children who are experiencing breathing problems, fluid or infections in the ear, and circulation problems where elevation would be beneficial.

2. Description of the Related Art Including Information Disclosed Under 37 CFR §§ 1.97–1.98

The prior art discloses a number of designs which are somewhat relevant but fail to disclose the invention claimed herein.

U.S. Pat. No. 5,272,780 to CLUTE discloses an infant support pillow wherein two pads are placed within openings spaced from one another to define a channel that receives an infant placed on its side within the channel. The main object of this patent is to prevent SIDS.

U.S. Pat. No. 4,607,402 to POLLARD discloses an array of pockets in which cylindrically shaped foam members are removably inserted to define a retainer structure enclosing a sleeping area.

U.S. Pat. No. 5,095,569 to GLENN discloses a compliant cover sheet for a face down pillow that has a wedge shape and contains primary and secondary air passageways to facilitate breathing.

Also of interest is U.S. Pat. No. 5,996,147 to TRIMBLE, which discloses a bed sheet and pillow combination. This patent teaches the combination of a sheet and pillowcase with pockets on the reverse side of the sheet.

Of further interest are, U.S. Pat. No. 5,438,719 to ANTHONY; U.S. Pat. No. 5,991,946 to HARRIS; and, U.S. Pat. No. 5,367,730 to SHER.

The inventor has proposed a unique arrangement which appears patentable over the foregoing prior art and introduces distinctive features which accomplish the objects proposed herein.

SUMMARY OF THE INVENTION

This invention relates to a pocket pillow and sheet combination wherein contoured pillows may be inserted into the reverse side of the sheet in order to provide aid and security to a person lying on a mattress on and between said pillows.

The pocket pillow sheet comprises a plurality of pockets on the reverse side thereof and the pockets cooperate with pillows which are inserted therein to provide a desired contour on the upper surface of the sheet. Thus, there is no problem with the pillows being tossed about and the pillows provide appropriate restraint and elevation particularly for infants. The contoured shape of the pillows also permits the infant to comfortably reside within the pillow without danger.

The invention may also be used as an elevation sleep aid for adults wherein shaped pillows may be inserted into one of the pockets in an adjustable arrangement. For example, the pillows may include a plurality of strips which adhere to one another by Velcro® or hook and loop mountings so that the precise elevation can be obtained. Alternatively, the pillows may include a solid pillow that is inserted into one or more hollow pillows. The contoured shape of the pillows prevents rolling over. A crescent shaped pillow may also be used for children to prevent slipping down through the base of the pillow enclosure, while such crescent pillows may be used for adults to elevate their legs. For further flexibility, the pockets may be arranged on the side and base portion with one or more pockets to provide for growth of the individual.

Accordingly, an object of this invention is to provide a new and improved pocket pillow and sheet arrangement which is inexpensive and easy to use.

Another object of this invention is to provide a new and improved sheet and pillow arrangement wherein the pillows are mounted on the reverse side of the sheet in an adjustable arrangement to provide elevation for the user.

A still further object of this invention is to provide a new and improved pocket pillow and sheet arrangement wherein crescent shaped pillows are used to provide an adjustable elevational aid.

A more specific object of this invention is to provide a new and improved pocket pillow and sheet combination wherein a plurality of pockets are provided on the base and sides of the sheet on the reverse side thereof in order to provide adjustable elevational aid and restraints for a party sleeping therewithin.

BRIEF DESCRIPTION OF THE DRAWINGS

The above and other objects of the invention may be more readily seen when viewing in conjunction with the accompanying drawings wherein.

DETAILED DESCRIPTION OF THE INVENTION

The invention is intended for home use for infants, children and adults and elevates an individual with breathing problems and fluid infections in the ear and circulation and congestion problems where elevation would be beneficial. The invention can also be used in hospitals and hospices for medical conditions requiring elevation. The particular pillows may be contoured for each size sheet whether crib, twin, fill, queen or king. The pillows 18 and 30 are adjustable for individuals of different heights. The pockets 12, 13*a*, 13*b*, 14*a*, 14*b* and 16*a–c* are also collapsible to permit the sheet 11 the lie flat when pillows are taken out. Either a drawstring on the rear of the sheet 11 or elastic materials such as cotton, synthetic elastic blend such as SPANDEX® or other material can achieve this. Thus, the sheet 11 may be used either as a fitted sheet with the collapsed pockets 12, 13*a–b*, 14*a–b* and 16*a–c* or an elevation sheet. When elevation is needed, the sheet 11 need not be changed. All one has to do is slip pillows into the pockets 12, 13*a–b*, 14*a–b* and 16*a–c*. After removing the pillows, the sheet 11 is flat, comfortable to sleep on and has no slack due to the pockets. The pillows may also be used with or without pillowcases.

Figure 1:
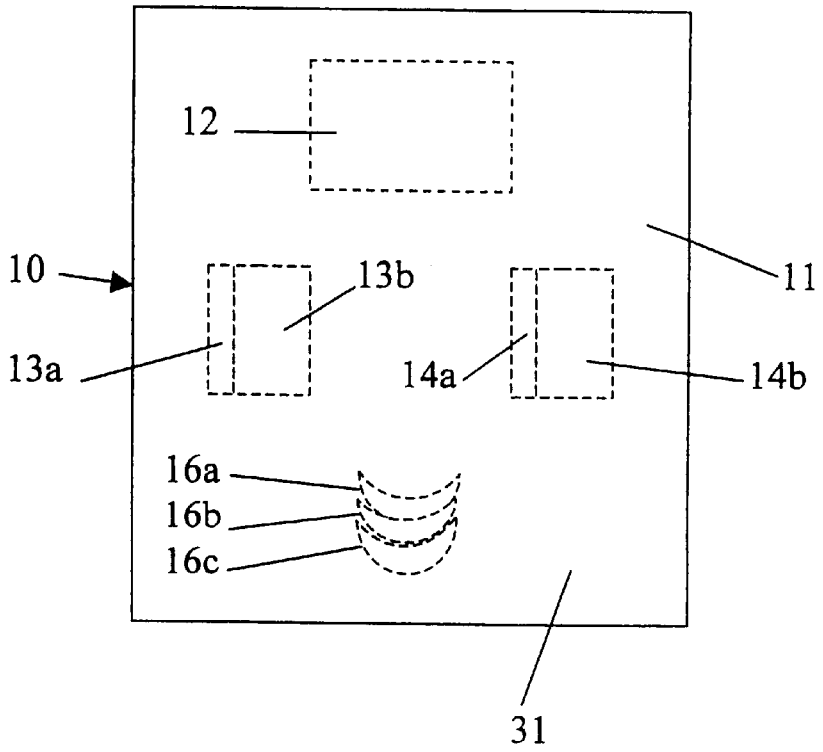
FIG. 1 is a top view of the invention with the pillows shown in phantom.
Figure 2:
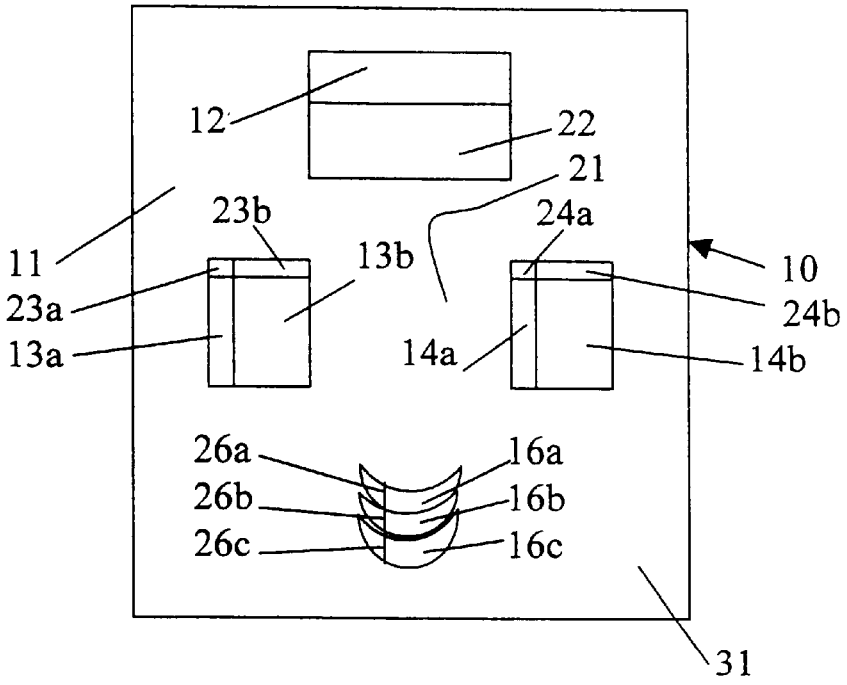
FIG. 2 is a rear view of the sheet showing the flaps to insert pillows.
Figure 3:
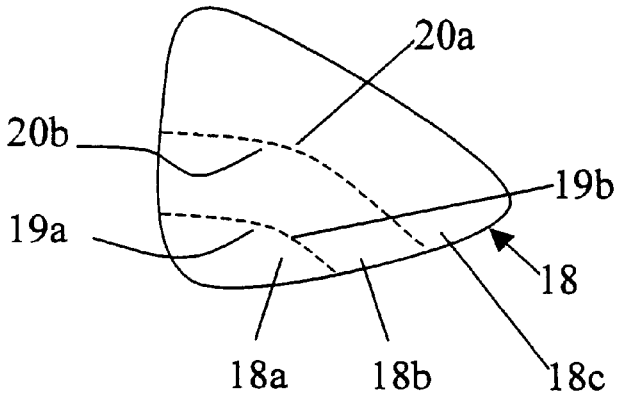
FIG. 3 is a side view of a an adjustable contoured pillow.
Figure 4:
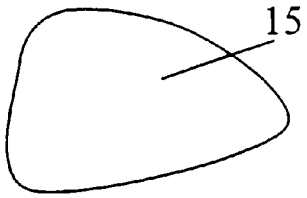
FIG. 4 is a side view showing a contoured shaped pillow.
Figure 5:
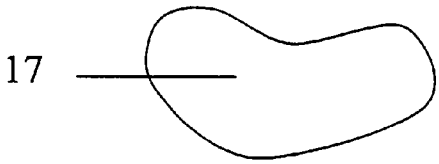
FIG. 5 is a side view of a crescent shaped pillow in a side view.

The crescent shaped pillow 17 is designed for children to prevent them from slipping down within the area 21 when their head is elevated. The pillow 17 can also be used for adults to elevate their legs. The children's version of pillow 17 is shorter. Adults, however, will be able to adjust the height of elevation with shaped pillows as shown in FIG. 5. The contoured pillow 18 shown in FIG. 3 includes a plurality of strips 18*a*–18*c*, which attach to one another with Velcro® or hook and loop mountings 19*a*–19*b* and 20*a*–20*b* to provide a predetermined height for the pillows 18. The pillow inserted into pocket 12 may be a conventional pillow (not shown) or a contoured pillow 15.

When the pillows 15, 17 and 18 have been inserted in to pockets 12, 13, 14 and 16*a–c*, the top of the sheet 11 is smooth and the pillows stay in place when the sheet 11 is attached to the mattress. The head of the sheet 11 normally contains one pocket for a conventional pillow 22 while there are generally two pockets 13*a–b* and 14*a–b* on each side for pillows 15 or 18 to allow for growth. At the base of the sheet 11 are three pockets 16*a–c* at the bottom to allow for growth or elevation. The pillows sections 18*a–c* can be removed as the individual grows and a larger space is needed within the area 21.

Figure 6:
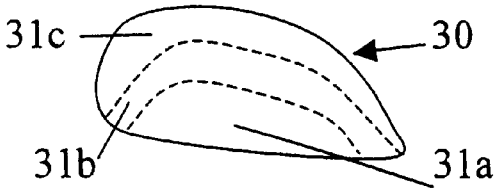
FIG. 6 is a side view of the pillow of FIG. 7 through the line 6—6.
Figure 7:
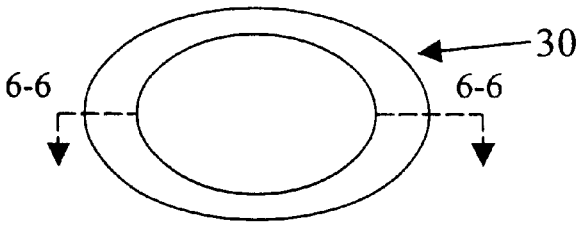
FIG. 7 is a bottom view of an alternate embodiment of the invention.

In an alternate embodiment shown in FIGS. 6 and 7, the pillow 30 comprises a solid core pillow 31*a* that fits into hollow pillow 31*b* that fits into hollow pillow 31*c*. Thus an adjustable side pillow 30 may be provided with no hooks or Velcro®, is easy to wash and particularly desirable in hospitals. The pillow 30 is easy to assemble, less complicated and has fewer pieces to deal with. The pillow 30 is also stable and would not shift or move out of place.

The invention is intended for home use for infants, children and adults and elevates an individual with breathing problems and fluid infections in the ear and circulation and congestion problems where elevation would be beneficial. The invention can also be used in hospitals and hospices for medical conditions requiring elevation. The particular pillows may be contoured for each size sheet whether crib, twin, full, queen or king. The pillows 18 and 30 are adjustable for individuals of different heights. The pockets 12, 13*a*, 13*b*, 14*a*, 14*b* and 16*a–c* are also collapsible to permit the sheet 11 the lie flat when pillows are taken out. Either a drawstring on the rear of the sheet 11 or elastic materials such as cotton, Spandex blend or other material can achieve this. Thus, the sheet 11 may be used either as a fitted sheet with the collapsed pockets 12, 13*a–b*, 14*a–b* and 16*a–c* or an elevation sheet. When elevation is needed, the sheet 11 need not be changed. All one has to do is slip pillows into the pockets 12, 13*a–b*, 14*a–b* and 16*a–c*. After removing the pillows, the sheet 11 is flat, comfortable to sleep on and has no slack due to the pockets. The pillows may also be used with or without pillowcases.

Figure 8:
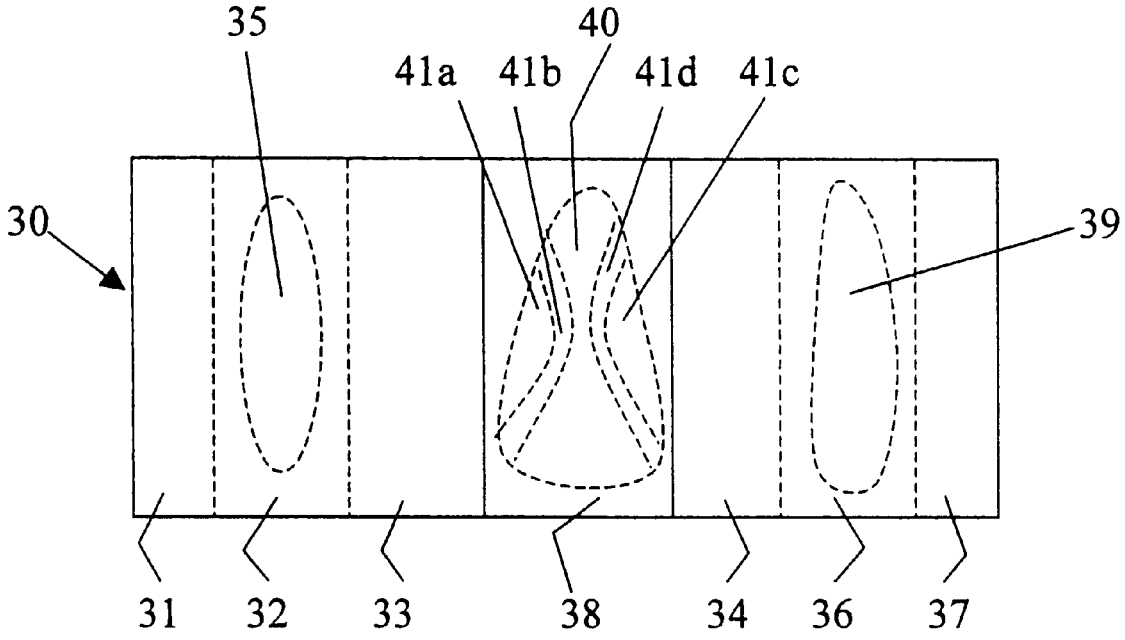
FIG. 8 is a top view of an alternate embodiment of the invention with the pillows shown in phantom.

The invention as illustrated in FIG. 8 may be used with the option of elevation, non-elevation or positioning in cases of hip or knee replacement. The sheet 30 includes pockets 31, 32, 34, 36–37 that may be used as needed to change the location of the pillow 35 and 39 to elevate or position the leg or hip. Pocket 38 may be used with shaped pillow 40 to go between a person's legs. The pillow 40 also includes adjustable Velcro® or hook and loop strips 41*a–d* to adjust the support offered by the pillow 30.

While the invention has been explained by a detailed description of certain specific embodiments, it is understood that various modifications and substitutions can be made in any of them within the scope of the appended claims, which are intended also to include equivalents of such embodiments.

What is claimed is:

1. A pocket pillow and sheet combination to assist sleepers comprises:

a substantially rectangular sheet having topside and a bottom-side and an upper portion and lower portion;

a plurality of pockets on the bottom-side thereof for the insertion of pillows comprising a head pocket on the upper portion, first and second side pockets spaced from each other and located longitudinally along the sheet and a plurality of base pockets at the lower portion adjacent the side, said base pockets having a crescent shape;

a pillow for insertion into the head pocket;

a plurality of crescent shaped pillows for insertion into the respective crescent shaped pockets; and, a first pillow and a second pillow for insertion into the first and second side pockets respectively, each comprising a plurality of shaped strips having hook and loop fasteners on the surface thereof to connect said strips together to form a predetermined pillow shape.

2. A pocket pillow and sheet combination in accordance with claim 1 wherein:

the first and second pillows inserted into the side pockets comprise contoured pillows.

3. A pocket pillow and sheet combination to assist sleepers in accordance with claim 1 wherein:

the sheet includes flaps over each pocket to retain the pillows in position.

4. A pocket pillow and sheet combination to assist sleepers in accordance with claim 1 wherein:

the sheet further includes elasticized ties along the sides to permit use the sheet without pillows.

* * * * *